US009373889B2

(12) United States Patent
Chen et al.

(10) Patent No.: US 9,373,889 B2
(45) Date of Patent: Jun. 21, 2016

(54) ULTRA-WIDEBAND ANTENNA AND TERMINAL

(75) Inventors: Yajun Chen, Shenzhen (CN); Shougang Cheng, Shenzhen (CN); Jun Shen, Shenzhen (CN); Yu Qin, Shenzhen (CN)

(73) Assignee: ZTE Corporation, Shenzhen, Guangdong (CN)

( * ) Notice: Subject to any disclaimer, the term of this patent is extended or adjusted under 35 U.S.C. 154(b) by 444 days.

(21) Appl. No.: 14/118,531

(22) PCT Filed: Apr. 24, 2012

(86) PCT No.: PCT/CN2012/074624

§ 371 (c)(1),
(2), (4) Date: Nov. 18, 2013

(87) PCT Pub. No.: WO2013/000331

PCT Pub. Date: Jan. 3, 2013

(65) Prior Publication Data

US 2014/0104129 A1 Apr. 17, 2014

(30) Foreign Application Priority Data

Jun. 29, 2011 (CN) ..... 2011 1 0178840

(51) Int. Cl.
*H01Q 5/25* (2015.01)
*H01Q 5/378* (2015.01)
(Continued)

(52) U.S. Cl.
CPC ..... *H01Q 5/0017* (2013.01); *H01Q 1/243* (2013.01); *H01Q 1/38* (2013.01); *H01Q 5/25* (2015.01); *H01Q 5/378* (2015.01); *H01Q 9/40* (2013.01); *H01Q 9/42* (2013.01)

(58) Field of Classification Search
CPC ..... H01Q 5/0017; H01Q 5/25; H01Q 5/378; H01Q 5/385; H01Q 9/40; H01Q 1/38
USPC ..... 343/850
See application file for complete search history.

(56) References Cited

U.S. PATENT DOCUMENTS 6,603,429 B1 * 8/2003 Bancroft ..... H01Q 1/243 343/700 MS
7,042,414 B1 * 5/2006 Lee ..... H01Q 1/243 343/795

(Continued)

FOREIGN PATENT DOCUMENTS

CN 101145635 A 3/2008
CN 201035603 Y 3/2008

(Continued)

OTHER PUBLICATIONS

International Search Report in international No. PCT/CN2012/074624, mailed on Aug. 9, 2012. (2 pages—see entire document).

(Continued)

*Primary Examiner* — Dameon E Levi
*Assistant Examiner* — Jennifer F Hu
(74) *Attorney, Agent, or Firm* — Oppedahl Patent Law Firm LLC

(57) ABSTRACT

The present disclosure discloses an ultra-wideband antenna, including: a coplanar waveguide feeder connected to a Radio Frequency (RF) excitation port on the PCB substrate at one end and to a tapering supporting arm at the other end; the tapering supporting arm connected to the coplanar waveguide feeder at one end and to a primary radiating closed-band-shaped monopole at the other end; the primary radiating closed-band-shaped monopole connected to the tapering supporting arm; a primary coupling patch located in the area closed by the closed band of the primary radiating closed-band-shaped monopole; a secondary radiating closed-band-shaped monopole connected to the primary radiating closed-band-shaped monopole through a metallic via; and a secondary coupling patch located in the area closed by the closed band of the secondary radiating closed-band-shaped monopole. The present disclosure also discloses an ultra-wideband terminal. With the antenna and the terminal of the present disclosure, space usage is reduced, facilitating development of an ultrathin terminal and widening bandwidth, and thus allowing the terminal to operate in the range of an ultra-wide band.

12 Claims, 3 Drawing Sheets

(51) Int. Cl.

| | |
|---|---|
| ***H01Q 5/00*** | (2015.01) |
| ***H01Q 1/24*** | (2006.01) |
| ***H01Q 1/38*** | (2006.01) |
| ***H01Q 9/40*** | (2006.01) |
| ***H01Q 9/42*** | (2006.01) |

(56) References Cited

U.S. PATENT DOCUMENTS

| | | | | |
|---|---|---|---|---|
| 2003/0156064 | A1* | 8/2003 | Bancroft | H01Q 1/243 343/700 MS |
| 2006/0097925 | A1 | 5/2006 | Lee | |
| 2009/0046016 | A1* | 2/2009 | Tseng | H01Q 5/00 343/700 MS |
| 2010/0013719 | A1* | 1/2010 | Yen | H01Q 1/243 343/702 |
| 2010/0220023 | A1* | 9/2010 | Ge | H01Q 1/22 343/772 |
| 2010/0328164 | A1* | 12/2010 | Huynh | H01Q 1/243 343/702 |
| 2013/0035050 | A1* | 2/2013 | Gao | H01Q 1/243 455/193.1 |

FOREIGN PATENT DOCUMENTS

| | | | |
|---|---|---|---|
| CN | 201188452 | Y | 1/2009 |
| CN | 1917287 | B | 11/2010 |
| CN | 102394361 | A | 3/2012 |
| KR | 20090120282 | A | 11/2009 |
| TW | 201115840 | A | 5/2011 |

OTHER PUBLICATIONS

English Translation of the Written Opinion of the International Search Authority in international application No. PCT/CN2012/074624, mailed on Aug. 9, 2012. (7 pages—see entire document).

Hsien-Wen Liu et al: "Compact Monopole Antenna With Band-Notched Characteristic for UWB Applications", IEEE Antennas and Wireless Propagation Letters, IEEE, Piscataway, NJ, US, vol. 9, Jan. 1, 2010; pp. 397-400.

Almalkawi M et al: "Ultrawideband Antenna With Triple Band-Notched Characteristics Using Closed-Loop Ring Resonators", IEEE Antennas and Wireless Propagation Letters, IEEE, Piscataway, NJ, US, vol. 10, Jan. 1, 2011, pp. 959-962.

Arivazhagan S et al: "Design and simulation of UWB planar rectangular printed antenna", Computer, Communication and Electrical Technology (ICCCET), 2011 International Conference On, IEEE, Mar. 18, 2011, pp. 222-227.

Matsuda Y et al: "A Single Feed Planar UWB Antenna with Stopband in 5GHz", Communications and Information Technologies (ISCIT), 2010 International Symposium On, IEEE, Piscataway, NJ, USA, Oct. 26, 2010, pp. 793-797.

Supplementary European Search Report in European application No. 12804068.0, mailed on Mar. 7, 2014. (7 pages—see entire document).

* cited by examiner

ULTRA-WIDEBAND ANTENNA AND TERMINAL

TECHNICAL FIELD

The disclosure relates to the field of antenna, and in particular to an ultra-wideband antenna and terminal.

BACKGROUND

With the development of world economy, mobile communication evolves continuously from a $3^{rd}$ generation to a $4^{th}$ generation, and there is an increasing demand for a multi-mode, multi-band, and multi-system mobile terminal such as a global-mode mobile phone or data card. It poses a great challenge to design of an antenna how to implement omnidirectional operation covering an ultrawide band of 0.8 GHz-5.5 GHz with a single antenna as a front portion of a mobile phone in a compact space, so as to save space and cost of the mobile terminal and facilitate development of a miniaturized and ultrathin mobile terminal.

At present, technology for widening the bandwidth of an antenna is mainly limited to improvement on the form of an antenna such as a planar inverted-F antenna (PIFA), an inverted-F antenna (IFA), a monopole antenna and the like, such as short-circuit point addition in multiple branches, appending of a parasitic structure, addition of a slotted structure, extension of a current path, and the like; and it is also possible to implement multi-band characteristics through different combinations of slots with microstrip feeders. However, with increase in the number of modes of mobile communication, expansion of the bandwidth of a mobile terminal as well as development of data services, there exists a serious bottleneck of a narrow bandwidth coverage and an increased demand for space by the parasitic structure in an aforementioned way of improvement, which is thus difficult to be implemented on the miniaturized and ultrathin mobile terminal.

SUMMARY

In view of this, the main purpose of the disclosure is to provide an ultra-wideband antenna and terminal, so as to reduce space usage and facilitate development of an ultrathin terminal and bandwidth widening, thus allowing the terminal to operate in the range of the ultrawide band.

To achieve the above purpose, a technical solution of the present disclosure is implemented as follows.

The present disclosure provides an ultra-wideband antenna, including: a coplanar waveguide feeder, a tapering supporting arm, a primary radiating closed-band-shaped monopole, a primary coupling patch, a secondary radiating closed-band-shaped monopole, a secondary coupling patch and a Printed Circuit Board (PCB) substrate, wherein the coplanar waveguide feeder, the tapering supporting arm, the primary radiating closed-band-shaped monopole and the primary coupling patch are located on one side of the PCB substrate, and the secondary radiating closed-band-shaped monopole and the secondary coupling patch are located on the other side of the PCB substrate;

the coplanar waveguide feeder is connected to a Radio Frequency (RF) excitation port on the PCB substrate at one end, and connected to the tapering supporting arm at the other end, and is configured to transmit a current of the RF excitation port to the tapering supporting arm;

the tapering supporting arm is connected to the coplanar waveguide feeder at one end, and connected to the primary radiating closed-band-shaped monopole at the other end, and is configured to transmit the current to the primary radiating closed-band-shaped monopole;

the primary radiating closed-band-shaped monopole is connected to the tapering supporting arm, and forms electromagnetic coupling with the primary coupling patch;

the primary coupling patch is located in the area closed by the closed band of the primary radiating closed-band-shaped monopole, and is spaced apart from the primary radiating closed-band-shaped monopole by a distance that enables the primary radiating closed-band-shaped monopole to form electromagnetic coupling with the primary coupling patch;

the secondary radiating closed-band-shaped monopole is connected to the primary radiating closed-band-shaped monopole through a metallic via, and forms electromagnetic coupling with the secondary coupling patch; and the secondary coupling patch is located in the area closed by the closed band of the secondary radiating closed-band-shaped monopole, and is spaced apart from the secondary radiating closed-band-shaped monopole by a distance that enables the secondary radiating closed-band-shaped monopole to form electromagnetic coupling with the secondary coupling patch.

In the solution, the widths of the closed bands of the primary radiating closed-band-shaped monopole and of the secondary radiating closed-band-shaped monopole may each be greater than 0.5 mm, and the relationship between a perimeter and a resonant frequency of each of the closed bands should be such that the perimeter equals to the speed of light divided by 2 and by the resonant frequency.

In the solution, the primary radiating closed-band-shaped monopole and the secondary radiating closed-band-shaped monopole may be rectangular-shaped closed bands each with a closed-band width of more than 0.5 mm and a closed-band perimeter between 100 mm and 200 mm; and accordingly, the primary coupling patch and the secondary coupling patch may be rectangles each with a perimeter between 50 mm to 100 mm.

In the solution, an impedance in the coplanar waveguide feeder and the tapering supporting arm may be 50 Ohm.

In the solution, there may not be interference between a projected area of the PCB substrate and the primary radiating closed-band-shaped monopole, the primary coupling patch, the secondary radiating closed-band-shaped monopole, the secondary coupling patch, or the tapering supporting arm.

In the solution, the metallic via connecting the primary radiating closed-band-shaped monopole and the secondary radiating closed-band-shaped monopole may be located at a predetermined position that maximizes a current of the primary radiating closed-band-shaped monopole.

The disclosure further provides an ultra-wideband terminal, including an antenna, an inputting module, and a displaying module, wherein the inputting module is configured to convert input information into an RF signal, and send the RF signal to the antenna;

the displaying module is configured to demodulate and display an RF signal received by the antenna;

the antenna is configured to transmit the RF signal sent by the inputting module and send the received RF signal to the displaying module; the antenna includes: a coplanar waveguide feeder, a tapering supporting arm, a primary radiating closed-band-shaped monopole, a primary coupling patch, a secondary radiating closed-band-shaped monopole, a secondary coupling patch and a Printed Circuit Board (PCB) substrate, wherein the coplanar waveguide feeder, the tapering supporting arm, the primary radiating closed-band-shaped monopole and the primary coupling patch are located on one side of the PCB substrate, and the secondary radiating closed-band-shaped monopole and the secondary coupling patch are located on the other side of the PCB substrate;

the coplanar waveguide feeder is connected to a Radio Frequency (RF) excitation port on the PCB substrate at one end, and connected to the tapering supporting arm at the other end, and is configured to transmit a current of the RF excitation port to the tapering supporting arm;

the tapering supporting arm is connected to the coplanar waveguide feeder at one end, and connected to the primary radiating closed-band-shaped monopole at the other end, and is configured to transmit the current to the primary radiating closed-band-shaped monopole;

the primary radiating closed-band-shaped monopole is connected to the tapering supporting arm, and forms electromagnetic coupling with the primary coupling patch;

the primary coupling patch is located in the area closed by the closed band of the primary radiating closed-band-shaped monopole, and is spaced apart from the primary radiating closed-band-shaped monopole by a distance that enables the primary radiating closed-band-shaped monopole to form electromagnetic coupling with the primary coupling patch;

the secondary radiating closed-band-shaped monopole is connected to the primary radiating closed-band-shaped monopole through a metallic via, and forms electromagnetic coupling with the secondary coupling patch; and the secondary coupling patch is located in the area closed by the closed band of the secondary radiating closed-band-shaped monopole, and is spaced apart from the secondary radiating closed-band-shaped monopole by a distance that enables the secondary radiating closed-band-shaped monopole to form electromagnetic coupling with the secondary coupling patch.

In the solution, the widths of the closed bands of the primary radiating closed-band-shaped monopole and of the secondary radiating closed-band-shaped monopole may each be greater than 0.5 mm, and the relationship between a perimeter and a resonant frequency of each of the closed bands should be such that the perimeter equals to the speed of light divided by 2 and by the resonant frequency.

In the solution, the primary radiating closed-band-shaped monopole and the secondary radiating closed-band-shaped monopole may be rectangular-shaped closed bands each with a closed-band width of more than 0.5 mm and a closed-band perimeter between 100 mm and 200 mm; and accordingly, the primary coupling patch and the secondary coupling patch may be rectangles each with a perimeter between 50 mm and 100 mm.

In the solution, an impedance in the coplanar waveguide feeder and the tapering supporting arm may be 50 Ohm.

In the solution, there may not be interference between a projected area of the PCB substrate and the primary radiating closed-band-shaped monopole, the primary coupling patch, the secondary radiating closed-band-shaped monopole, the secondary coupling patch, or the tapering supporting arm.

In the solution, the metallic via connecting the primary radiating closed-band-shaped monopole and the secondary radiating closed-band-shaped monopole may be located at a predetermined position that maximizes a current of the primary radiating closed-band-shaped monopole.

Therefore, with the antenna and the terminal described in the present disclosure, the primary radiating closed-band-shaped monopole and the secondary radiating closed-band-shaped monopole may be laid out utilizing the space near the edge of the Printed Circuit Board (PCB) substrate, which reduces the space usage, and the primary radiating closed-band-shaped monopole and the secondary radiating closed-band-shaped monopole are connected with each other through the metallic via and are located on opposite sides of the PCB substrate, facilitating design of an ultrathin terminal; electromagnetic coupling among the primary radiating closed-band-shaped monopole, the secondary radiating closed-band-shaped monopole, the primary coupling patch and the secondary coupling patch widens the bandwidth, which may allow the terminal to operate in the range of the ultrawide band; the impedance of the tapering supporting arm and the coplanar waveguide feeder allows the antenna to have good impedance matching within the frequency band, thus further optimizing characteristics of ultra-wideband operation of the antenna.

DETAILED DESCRIPTION

According to various embodiments of the present disclosure, a tapering supporting arm and a coplanar waveguide feeder transmit a current of an RF excitation port to a primary radiating closed-band-shaped monopole, which is coupled with a primary coupling patch; meanwhile, the primary radiating closed-band-shaped monopole transmits the current to a secondary radiating closed-band-shaped monopole through a metallic via, and the secondary radiating closed-band-shaped monopole is coupled with a secondary coupling patch.

The present disclosure will be elaborated below with reference to specific embodiments and the accompanying drawings.

Figure 1:
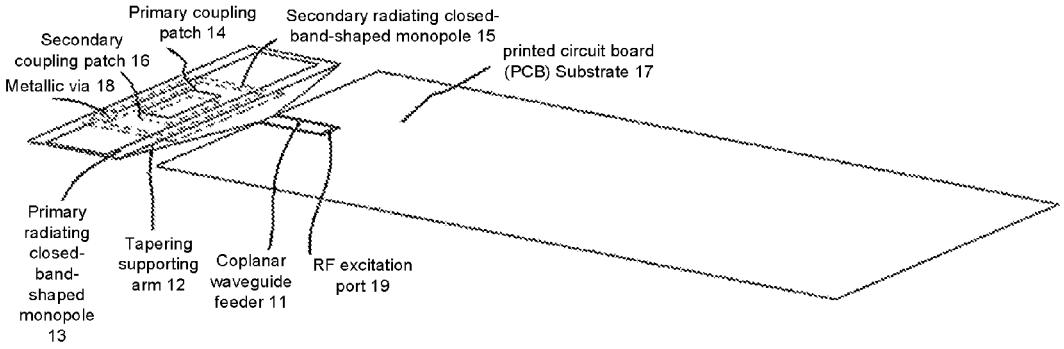
FIG. 1 is a schematic diagram of the structure of an ultra-wideband antenna according to the present disclosure.
Figure 2:
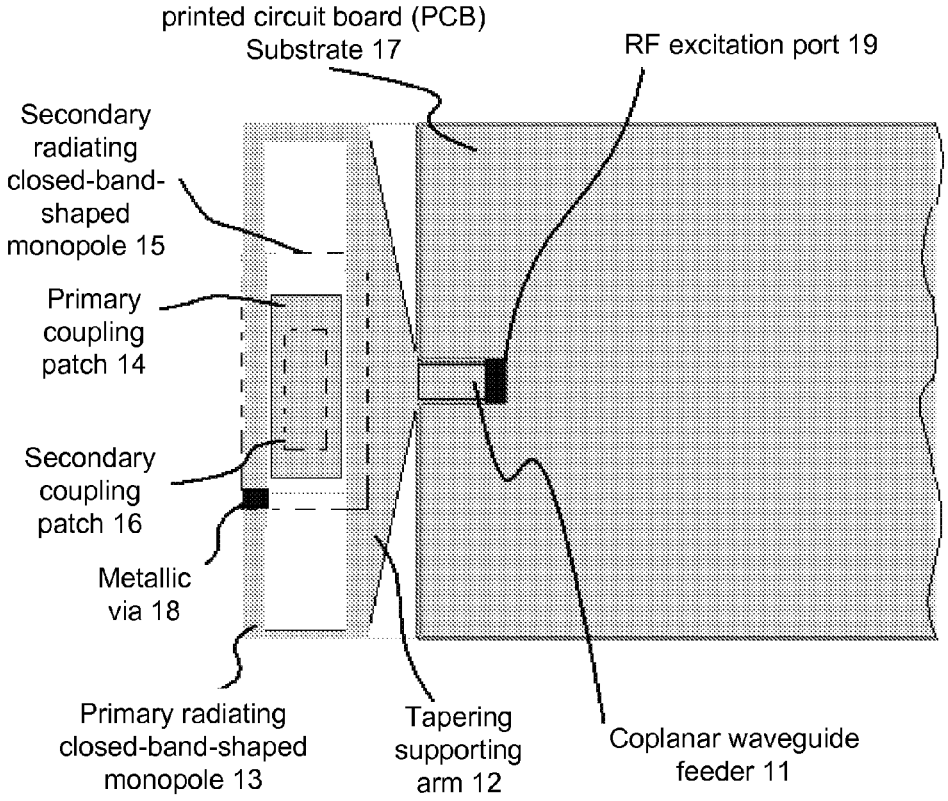
FIG. 2 is a top view of the ultra-wideband antenna according to the present disclosure.

An ultra-wideband antenna, as shown in FIG. 1 and FIG. 2, includes: a primary radiating closed-band-shaped monopole 13, a primary coupling patch 14, a tapering supporting arm 12, a coplanar waveguide feeder 11, a secondary radiating closed-band-shaped monopole 15, a secondary coupling patch 16 and a Printed Circuit Board (PCB) substrate 17; FIG. 2 is a top view.

Wherein, the primary radiating closed-band-shaped monopole 13, the tapering supporting arm 12, the coplanar waveguide feeder 11 and the primary coupling patch 14 are photoetched on one side of the PCB substrate 17 through a microstrip fabricating process.

Figure 3:
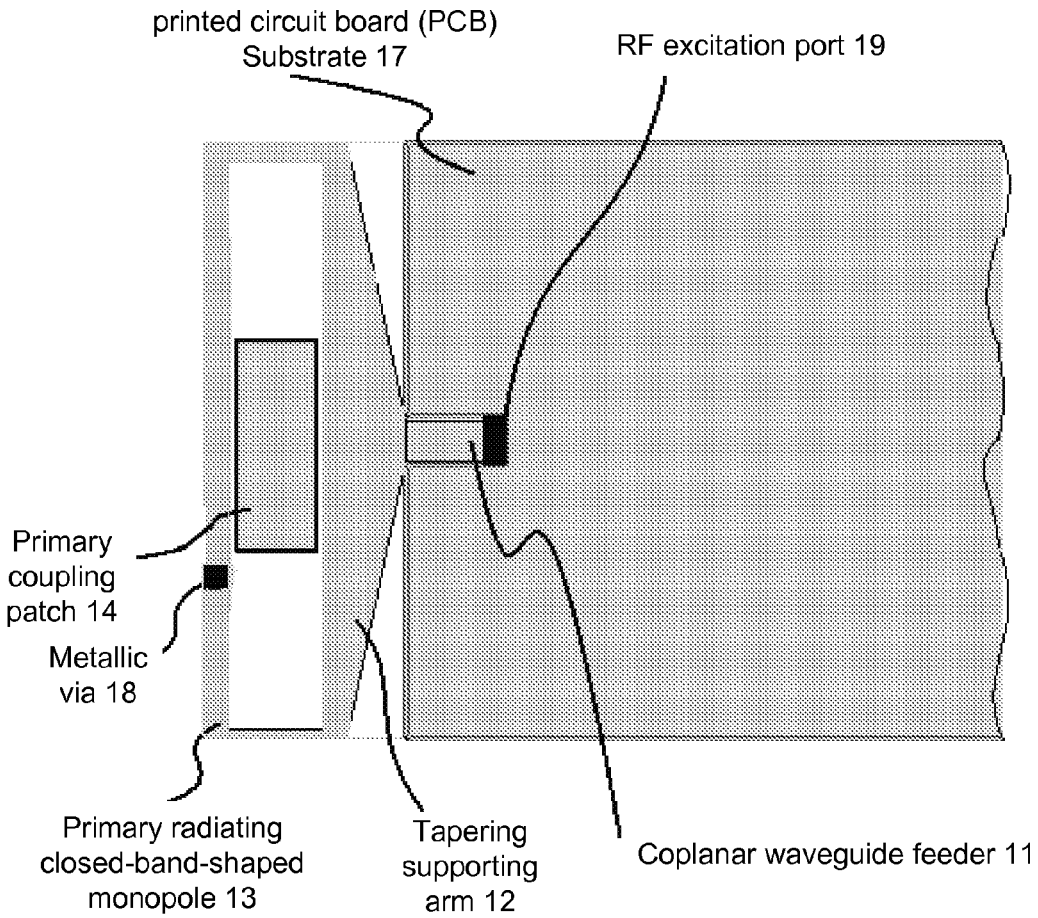
FIG. 3 is a front view of a primary radiating closed-band-shaped monopole, a tapering supporting arm, a coplanar waveguide feeder and a primary coupling patch in the present disclosure.
Figure 4:
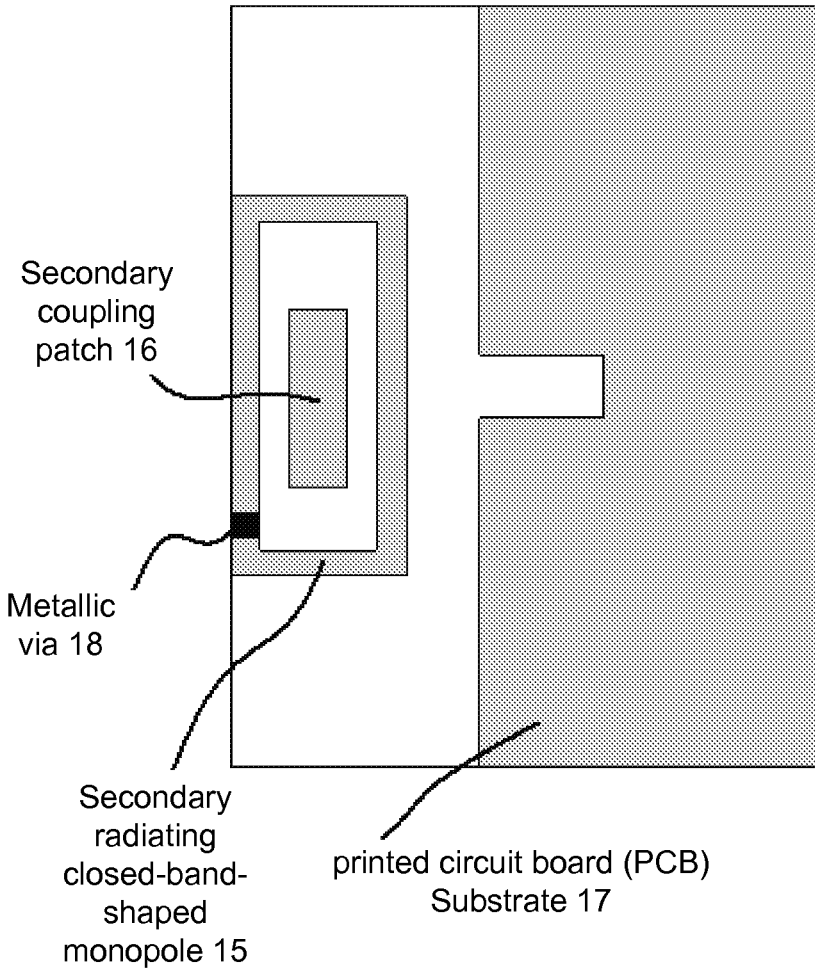
FIG. 4 is a front view of a secondary radiating closed-band-shaped monopole and a secondary coupling patch in the present disclosure.

Shown in FIG. 3 is a front view of the primary radiating closed-band-shaped monopole 13, the tapering supporting arm 12, the coplanar waveguide feeder 11 and the primary coupling patch 14;

The coplanar waveguide feeder 11 is connected to RF excitation port 19 on the PCB substrate 17 at one end and to the tapering supporting arm 12 at the other end, and is configured to transmit a current of the RF excitation port 19 to the tapering supporting arm 12;

The tapering supporting arm 12 is connected to the coplanar waveguide feeder 11 at one end and to the primary radiating closed-band-shaped monopole 13 at the other end, and is configured to transmit the current transmitted from the coplanar waveguide feeder 11 to the primary radiating closed-band-shaped monopole 13;

The primary radiating closed-band-shaped monopole 13 is connected to the tapering supporting arm 12, and is shaped as a closed band with a width of more than 0.5 mm, and a perimeter of the closed band is closely related to a resonant frequency of the closed band, satisfying formula (1): $L=C/2f$, wherein C is the speed of light, L is the perimeter and f is the resonant frequency;

The primary coupling patch 14 is located in the area closed by the closed band of the primary radiating closed-band-shaped monopole 13, and is spaced apart from the primary radiating closed-band-shaped monopole 13 by a distance ensuring that the primary radiating closed-band-shaped monopole 13 is coupled with the primary coupling patch;

The secondary radiating closed-band-shaped monopole 15 and the secondary coupling patch 16 are photoetched on the other side of the PCB substrate 17 through a microstrip fabricating process. Shown in FIG. 4 is a front view of the secondary radiating closed-band-shaped monopole 15 and the secondary coupling patch 16, wherein the secondary radiating closed-band-shaped monopole 15 is shaped as a closed band with a width of more than 0.5 mm, and the relationship between the width and perimeter of the closed band and the resonant frequency of the closed band satisfies the formula (1), the secondary radiating closed-band-shaped monopole 15 is connected to the primary radiating closed-band-shaped monopole 14 through a metallic via 18 on the PCB substrate 17;

The secondary coupling patch 16 is located in the area closed by the closed band of the secondary radiating closed-band-shaped monopole 15, and is spaced apart from the secondary radiating closed-band-shaped monopole 15 by a distance ensuring that the secondary radiating closed-band-shaped monopole 15 is coupled with the secondary coupling patch. For example, the distance is between 0.4 mm and 3 mm.

In the aforementioned ultra-wideband antenna, the coplanar waveguide feeder 11 and the tapering supporting arm 12 transmit the current of the RF excitation port to the primary radiating closed-band-shaped monopole 13 to excite the primary radiating closed-band-shaped monopole 13. There exists a difference in electric field between the primary radiating closed-band-shaped monopole 13 and the primary coupling patch 14, which form electromagnetic coupling, thus widening the frequency bandwidth. Since the secondary radiating closed-band-shaped monopole 15 is connected to the primary radiating closed-band-shaped monopole 13 through the metallic via 18, the secondary radiating closed-band-shaped monopole 15 is excited as well. The primary radiating closed-band-shaped monopole 13, the secondary radiating closed-band-shaped monopole 15, the primary coupling patch 14, and the secondary coupling patch 16 are coupled with each other, such that the antenna supports a frequency band of 700 MHz-5.5 GHz, with a return loss S11 less than −7.5 dB in a primary communication frequency band of 700 MHz-2.5 GHz, and a return loss S11 less than −4.8 dB over a frequency band of 2.5 GHz-5.5 GHz included in a global wireless local area network.

Further, the primary radiating closed-band-shaped monopole 13 and the secondary radiating closed-band-shaped monopole 15 may be a circular closed band, a rectangular closed band, or a closed band of another shape; the primary coupling patch 14 and the secondary coupling patch 16 may be circular, rectangular, or of another shape.

Further, the primary radiating closed-band-shaped monopole 13 is rectangular, with a perimeter between 100 mm and 200 mm;

Accordingly, the primary coupling patch 14 is rectangular, with a perimeter of 50 mm-100 mm.

The secondary radiating closed-band-shaped monopole 15 is rectangular, with a perimeter of 100 mm-200 mm;

Accordingly, the secondary coupling patch 16 is rectangular, with a perimeter of 50 mm-100 mm.

Further, metallic via 18 is preset at different positions, and currents of primary radiating closed-band-shaped monopoles 13 corresponding to the metallic via 18 at different positions are measured, the metallic via 18 connecting the primary radiating closed-band-shaped monopole 13 and the secondary radiating closed-band-shaped monopole 15 is set at a predetermined position that maximizes the current of the primary radiating closed-band-shaped monopole 13, so as to ensure a low-frequency resonance.

Further, the impedance of the coplanar waveguide feeder 11 and the tapering supporting arm 12 is 50 Ohm.

Further, there is no interference between a projected area of the PCB substrate 17 and the primary radiating closed-band-shaped monopole 13, the primary coupling patch 14, the secondary radiating closed-band-shaped monopole 15, the secondary coupling patch 16, or the tapering supporting arm 12.

Figure 5:
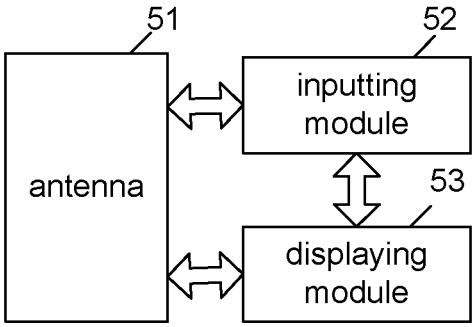
FIG. 5 is a schematic diagram of the structure of an ultra-wideband terminal in the present disclosure.

The present disclosure also provides an ultra-wideband terminal, as shown in FIG. 5, includes an antenna 51, an inputting module 52, and a displaying module 53, wherein the inputting module 52 is connected to the antenna 51 and the displaying module 53, and is configured to send input information to the displaying module 53, convert the input information into an RF signal, and send the RF signal to the antenna 51;

the displaying module 53 is connected to the inputting module 52 and the antenna 51, and is configured to display information input by the inputting module 52, and demodulate and display an RF signal received by the antenna 51;

the antenna 51 is connected to the inputting module 52 and the displaying module 53, and is configured to transmit the RF signal sent by the inputting module 53 and send the received RF signal to the displaying module 53.

The inputting module 52 is specifically configured to convert the input information into an RF signal by performing modulation such as encoding and up-conversion on the input information, wherein the method for the modulation is an existing technique and will not be repeated here.

The displaying module 53 is specifically configured to perform demodulation such as down-conversion and decoding on the received RF signal to acquire and display a baseband signal, wherein the demodulation is an existing technique and will not be repeated here.

Wherein, the structure of the antenna 51 is the same as that of the antenna shown in FIG. 1 and will not be repeated here.

What described are merely preferred embodiments of the present disclosure, and are not intended to limit the protection scope of the present disclosure.

The invention claimed is:

1. An ultra-wideband antenna, comprising: a coplanar waveguide feeder, a tapering supporting arm, a primary radiating closed-band-shaped monopole, a primary coupling patch, a secondary radiating closed-band-shaped monopole, a secondary coupling patch and a Printed Circuit Board (PCB) substrate, wherein the coplanar waveguide feeder, the tapering supporting arm, the primary radiating closed-band-shaped monopole and the primary coupling patch are located on one side of the PCB substrate, and the secondary radiating closed-band-shaped monopole and the secondary coupling patch are located on the other side of the PCB substrate;

the coplanar waveguide feeder is connected to a Radio Frequency (RF) excitation port on the PCB substrate at one end, and connected to the tapering supporting arm at the other end, and is configured to transmit a current of the RF excitation port to the tapering supporting arm;

the tapering supporting arm is connected to the coplanar waveguide feeder at one end, and connected to the primary radiating closed-band-shaped monopole at the other end, and is configured to transmit the current to the primary radiating closed-band-shaped monopole;

the primary radiating closed-band-shaped monopole is connected to the tapering supporting arm, and forms electromagnetic coupling with the primary coupling patch;

the primary coupling patch is located in the area closed by the closed band of the primary radiating closed-band-shaped monopole, and is spaced apart from the primary radiating closed-band-shaped monopole by a distance that enables the primary radiating closed-band-shaped monopole to form electromagnetic coupling with the primary coupling patch;

the secondary radiating closed-band-shaped monopole is connected to the primary radiating closed-band-shaped monopole through a metallic via, and forms electromagnetic coupling with the secondary coupling patch; and the secondary coupling patch is located in the area closed by the closed band of the secondary radiating closed-band-shaped monopole, and is spaced apart from the secondary radiating closed-band-shaped monopole by a distance that enables the secondary radiating closed-band-shaped monopole to form electromagnetic coupling with the secondary coupling patch.

2. The antenna according to claim 1, wherein the widths of the closed bands of the primary radiating closed-band-shaped monopole and of the secondary radiating closed-band-shaped monopole are each greater than 0.5 mm, and the relationship between a perimeter and a resonant frequency of each of the closed bands satisfies that the perimeter equals to the speed of light divided by 2 and by the resonant frequency.

3. The antenna according to claim 2, wherein the primary radiating closed-band-shaped monopole and the secondary radiating closed-band-shaped monopole are rectangular-shaped closed bands each with a closed-band width of more than 0.5 mm and a closed-band perimeter between 100 mm and 200 mm; and the primary coupling patch and the secondary coupling patch are rectangles each with a perimeter between 50 mm to 100 mm.

4. The antenna according to claim 1, wherein an impedance in the coplanar waveguide feeder and the tapering supporting arm is 50 Ohm.

5. The antenna according to claim 4, wherein there is no interference between a projected area of the PCB substrate and the primary radiating closed-band-shaped monopole, the primary coupling patch, the secondary radiating closed-band-shaped monopole, the secondary coupling patch, or the tapering supporting arm.

6. The antenna according to claim 5, wherein the metallic via connecting the primary radiating closed-band-shaped monopole and the secondary radiating closed-band-shaped monopole is located at a predetermined position that maximizes a current of the primary radiating closed-band-shaped monopole.

7. An ultra-wideband terminal, comprising an antenna, an inputting module, and a displaying module, wherein the inputting module is configured to convert input information into an RF signal, and send the RF signal to the antenna;

the displaying module is configured to demodulate and display an RF signal received by the antenna;

the antenna is configured to transmit the RF signal sent by the inputting module and send the received RF signal to the displaying module; the antenna comprises: a coplanar waveguide feeder, a tapering supporting arm, a primary radiating closed-band-shaped monopole, a primary coupling patch, a secondary radiating closed-band-shaped monopole, a secondary coupling patch and a Printed Circuit Board (PCB) substrate, wherein the coplanar waveguide feeder, the tapering supporting arm, the primary radiating closed-band-shaped monopole and the primary coupling patch are located on one side of the PCB substrate, and the secondary radiating closed-band-shaped monopole and the secondary coupling patch are located on the other side of the PCB substrate;

the coplanar waveguide feeder is connected to a Radio Frequency (RF) excitation port on the PCB substrate at one end, and connected to the tapering supporting arm at the other end, and is configured to transmit a current of the RF excitation port to the tapering supporting arm;

the tapering supporting arm is connected to the coplanar waveguide feeder at one end, and connected to the primary radiating closed-band-shaped monopole at the other end, and is configured to transmit the current to the primary radiating closed-band-shaped monopole;

the primary radiating closed-band-shaped monopole is connected to the tapering supporting arm, and forms electromagnetic coupling with the primary coupling patch;

the primary coupling patch is located in the area closed by the closed band of the primary radiating closed-band-shaped monopole, and is spaced apart from the primary radiating closed-band-shaped monopole by a distance that enables the primary radiating closed-band-shaped monopole to form electromagnetic coupling with the primary coupling patch;

the secondary radiating closed-band-shaped monopole is connected to the primary radiating closed-band-shaped monopole through a metallic via, and forms electromagnetic coupling with the secondary coupling patch; and the secondary coupling patch is located in the area closed by the closed band of the secondary radiating closed-band-shaped monopole, and is spaced apart from the secondary radiating closed-band-shaped monopole by a distance that enables the secondary radiating closed-band-shaped monopole to form electromagnetic coupling with the secondary coupling patch.

8. The terminal according to claim 7, wherein the widths of the closed bands of the primary radiating closed-band-shaped monopole and of the secondary radiating closed-band-shaped monopole are each greater than 0.5 mm, and the relationship between a perimeter and a resonant frequency of each of the closed bands satisfies that the perimeter equals to the speed of light divided by 2 and by the resonant frequency.

9. The terminal according to claim 8, wherein the primary radiating closed-band-shaped monopole and the secondary radiating closed-band-shaped monopole are rectangular-shaped closed bands each with a closed-band width of more than 0.5 mm and a closed-band perimeter between 100 mm and 200 mm; and the primary coupling patch and the secondary coupling patch are rectangles each with a perimeter between 50 mm to 100 mm.

10. The terminal according to claim 7, wherein an impedance in the coplanar waveguide feeder and the tapering supporting arm is 50 Ohm.

11. The terminal according to claim 10, wherein there is no interference between a projected area of the PCB substrate and the primary radiating closed-band-shaped monopole, the primary coupling patch, the secondary radiating closed-band-shaped monopole, the secondary coupling patch, or the tapering supporting arm.

12. The terminal according to claim 11, wherein the metallic via connecting the primary radiating closed-band-shaped monopole and the secondary radiating closed-band-shaped monopole is located at a predetermined position that maximizes a current of the primary radiating closed-band-shaped monopole.

* * * * *